US005253630A

United States Patent [19]

Akazaki et al.

[11] Patent Number: 5,253,630

[45] Date of Patent: Oct. 19, 1993

[54] AIR-FUEL RATIO CONTROL SYSTEM FOR INTERNAL COMBUSION ENGINES

[75] Inventors: Shusuke Akazaki; Kotaro Miyashita, both of Wako, Japan

[73] Assignee: Honda Giken Kogyo Kabushiki Kaisha, Tokyo, Japan

[21] Appl. No.: 945,519

[22] Filed: Sep. 16, 1992

[30] Foreign Application Priority Data

Sep. 18, 1991 [JP] Japan ..... 3-267181

[51] Int. Cl.[5] ..... F02D 41/14; F02D 41/16

[52] U.S. Cl. ..... 123/682; 123/679; 123/680; 123/687; 123/689

[58] Field of Search ..... 123/679, 680, 681, 682, 123/683, 684, 687, 689

[56] References Cited

U.S. PATENT DOCUMENTS

| | | | |
|---|---|---|---|
| 4,156,413 | 5/1979 | Taplin | 123/693 X |
| 4,169,440 | 10/1979 | Taplin et al. | 123/693 X |
| 4,452,207 | 6/1984 | Moore, Jr. | 123/676 |
| 4,509,489 | 4/1985 | Hasegawa et al. | 123/680 |
| 4,572,135 | 2/1986 | Nakajima et al. | 123/689 X |
| 4,644,921 | 2/1987 | Kobayashi et al. | 123/689 |
| 4,719,888 | 1/1988 | Kobayashi et al. | 123/683 |
| 5,014,668 | 5/1991 | Klenk et al. | 123/683 X |
| 5,033,440 | 7/1991 | Kumagai et al. | 123/680 |

*Primary Examiner*—Tony M. Argenbright
*Attorney, Agent, or Firm*—Lyon & Lyon

[57] ABSTRACT

An air-fuel ratio control system for an internal combustion engine controls the air-fuel ratio of a mixture supplied to the engine to a desired air-fuel ratio in response to an output from an exhaust gas ingredient concentration sensor. A first value of the desired air-fuel ratio is calculated based on the rotational speed of the engine and the load on the engine. A second value of the desired air-fuel ratio is calculated based results of determination on whether a vehicle on which the engine is installed has just started from a standing position thereof. A third value of the desired air-fuel ratio is calculated based on results of determination on whether the temperature of the engine is lower than a predetermined value. The largest value of at least the first to third values of the desired air-fuel ratio is set to a final value of the desired air-fuel ratio.

14 Claims, 12 Drawing Sheets

CALCURATION OF KCMDM
S1
DURING FUEL CUT ?
YES
NO
S3
IMMEDIATERY AFTER FUEL CUT ?
NO
YES
S4
| KCMD(n−1)−KACT(n−1) | > ΔKPFC ?
YES
S5
NO
FPFC = 1
FPFC = 0
S6
S7
CALCULATE KBSM
S8
CORRECT KBS ON START OF VEHICLE
S9
CORRECT KBS IN RESPONSE TO LOW TW
S10
CORRECT KBS IN RESPONSE TO HIGH LOAD
S11
CORRECT KBS IN RESPONSE TO HIGH TW
A
B

| FIG.6 | |
|---|---|
| FIG.6a | FIG.6b |

AIR-FUEL RATIO CONTROL SYSTEM FOR INTERNAL COMBUSION ENGINES

BACKGROUND OF THE INVENTION

1. Field of the Invention

This invention relates to an air-fuel ratio control system for internal combustion engines.

2. Prior Art

Conventionally, an air-fuel ratio control system for an internal combustion engine is known, which is adapted to control the air-fuel ratio of an air-fuel mixture supplied to the engine in response to an output from an exhaust gas ingredient concentration sensor arranged in the exhaust system, the sensor having an output characteristic which is approximately proportional to the concentration of an ingredient ($O_2$) in exhaust gases, to a desired air-fuel ratio set in response to operating conditions of the engine.

In an air-fuel ratio control system of this kind, the fuel injection period TOUT' (and hence the fuel injection amount) is controlled by correcting a basic value thereof by various correction coefficients such that the air-fuel ratio detected by the sensor (hereinafter referred to as "the supply air-fuel ratio") becomes equal to the desired air-fuel ratio. That is, in the above air-fuel ratio control system, the desired air-fuel ratio depends on varying operating conditions of the engine, so that correction coefficients are calculated based on engine coolant temperature TW, intake air temperature TA, and other engine operating parameters, respectively, and a basic fuel injection period TiM (read from a predetermined map) are multiplied by these correction coefficients by the use of the following equation (1') to calculate the fuel injection period TOUT':

$$TOUT' = TiM \times (KTW \times KTA \times KWOT \times \ldots) \times KLAF \times KCMDM \ldots (1')$$

where KTW represents an engine coolant temperature-dependent correction coefficient, KTA an intake air temperature-dependent correction coefficient, KWOT a high load correction coefficient, and KLAF an air-fuel ratio correction coefficient. Further, KCMDM represents a modified desired air-fuel ratio coefficient, which is generally obtained by multiplying a desired air-fuel ratio set according to the engine rotational speed NE and the intake pipe absolute pressure PBA by an air density-dependent correction coefficient KETC.

However, in the above air-fuel ratio control system, although the engine coolant temperature TW, the intake air temperature TA, etc. may largely change in response to the operating conditions of the engine, the fuel injection period TOUT' is calculated by multiplying the basic value TIM by numerous correction coefficients inlcuding those mentioned above, so that the fuel injection period TOUT' may unpreferably deviate from the optimum value. Particularly, in the case of so-called large-area feedback control in which the air-fuel ratio is feedback-controlled over a wide operating region or area of the engine by the use of a linear air-fuel ratio sensor (LAF sensor) as the linear output-type exhaust gas ingredient concentration sensor, it is additionally required to correct the fuel injection period even at the standing start of the vehicle (including idling), so that the number of multiplying terms, i.e. correction coefficients, increases, which makes it even more difficult to control the fuel injection period TOUT' to the optimum value in quick response to various operating conditions of the engine.

Further, the air-fuel ratio should desirably be accurately controlled in order to enhance the driveability, protect the engine, and reduce the fuel consumption. However, such accurate air-fuel ratio control is usually accompanied by complication of maps for obtaining suitable values of correction coefficients. For example, when the engine coolant temperature is low (e.g. during warming-up of the engine), the desired air-fuel ratio is generally required to be modified in the enriching direction to secure required driveability of the engine. To meet this requirement, it is necessary to provide a plurality of different maps for retrieval suitable for a high engine coolant temperature condition and a low engine coolant temperature condition, respectively, so that one of them may be selected according to the temperature conditions. This complicates the processing of calculation of the fuel injection period TOUT'.

Further, when the air-fuel ratio is to be shifted from a lean value to a rich value, it is necessary to once set the supply air-fuel ratio to a stoichiometric value and then shift it to a desired rich value, unless the engine is in a high-load condition, in order to avoid a drastic change in the air-fuel ratio, which may cause damage to the engine. This procedure for shifting the air-fuel ratio to an enriched value further complicates the processing of calculation of the related correction coefficient(s) (e.g. map retrieval).

SUMMARY OF THE INVENTION

It is the object of the invention to provide an air-fuel ratio control system for an internal combustion engine, which is capable of easily obtaining a desired air-fuel ratio without correcting a basic value of a fuel injection period by multiplying same by a large number of correction coefficients.

To attain the above object, the present invention provides an air-fuel ratio control system for an internal combustion engine installed on an automotive vehicle, the engine having an exhaust passage, the system including an exhaust gas ingredient concentration sensor arranged across the exhaust passage for detecting the air-fuel ratio of an air-fuel mixture supplied to the engine, the system controlling the air-fuel ratio of the mixture to a desired air-fuel ratio set according to operating conditions of the engine, in response to an output from the exhaust gas ingredient concentration sensor.

The air-fuel ratio control system according to the invention is characterized by comprising:

rotational speed-detecting means for detecting the rotational speed of the engine;

load-detecting means for detecting load on the engine;

first air-fuel ratio-calculating means for calculating a first value of the desired air-fuel ratio based on the engine rotational speed detected by the rotational speed-detecting means and the load on the engine detected by the load-detecting means;

start-determining means for determining whether or not the vehicle has just started from a standing position thereof;

second air-fuel ratio-calculating means for calculating a second value of the desired air-fuel ratio based on results of determination by the start-determining means;

low temperature-determining means for determining whether or not a temperature of the engine is lower than a predetermined value;

third air-fuel ratio-calculating means for calculating a third value of the desired air-fuel ratio based on results of determination by the low temperature-determining means; and setting means for setting the largest value of at least the first to third values of the desired air-fuel ratio calculated by the first to third air-fuel ratio-calculating means to a final value of the desired air-fuel ratio.

Preferably, the air-fuel ratio control system further includes high-load condition determining means for determining whether or not the engine is in a predetermined high-load condition, and fourth air-fuel ratio-calculating means for calculating a fourth value of the desired air-fuel ratio, and the setting means sets the largest value of at least the first to fourth values of the desired air-fuel ratio calculated by the first to fourth desired air-fuel ratio-calculating means to the final value of the desired air-fuel ratio.

More preferably, the air-fuel ratio control system further includes high temperature-determining means for determining whether or not the temperature of the engine is higher than a predetermined value, and fifth air-fuel ratio-calculating means for calculating a fifth value of the desired air-fuel ratio based on results of determination by the high temperature-determining means, and the setting means sets the largest value of at least the first to fifth values of the desired air-fuel ratio calculated by the first to fifth desired air-fuel ratio-calculating means to the final value of the desired air-fuel ratio.

Further preferably, the temperature of the engine is the temperature of coolant of the engine.

Preferably, the air-fuel ratio control includes fuel cut-determining means for determining whether or not the supply of fuel to the engine is being cut off, measuring means for measuring a time period elapsed after resumption of fuel supply to the engine when the fuel cut determining means has determined that the supply of fuel to the engine is not being cut off, and enabling means for permitting calculation of the desired air-fuel ratio when a predetermined time period has been measured by the measuring means.

Preferably, the air-fuel ratio control system includes gear shift-determining means for determining whether or not the transmission is being gear shifted, and inhibiting means for inhibiting the first air-fuel ratio-calculating means from calculating the first value of the desired air-fuel ratio when the gear shift-determining means has determined that the transmission is being gear shifted.

Further preferably, the gear shift-determining means includes load change-determining means for determining a change in load on the engine, the gear shift-determining means determining that the transmission is being shifted when the engine rotational speed detected by the rotational speed-detecting means exceeds a predetermined value, and the change in load on the engine exceeds a predetermined value.

Also preferably, the gear shift-determining means includes vehicle speed-detecting means for detecting the travelling speed of the vehicle, the gear shif-determining means determining whether the transmission is being gear shifted when the travelling speed of the vehicle detected by vehicle speed-detecting means exceeds a predetermined value.

Also preferably, the air-fuel ratio control system includes second measuring means for measuring a time period elapsed after termination of gear shifting of the transmission, and the inhibiting means inhibits the first air-fuel ratio-calculating means from calculating the first value of the desired air-fuel ratio before the time period measured by the second measuring means reaches a predetermined value.

Preferably, the start-determining means includes idling-determining means for determining whether or not the engine is idling.

The above and other objects, features, and advantages of the invention will become more apparent from the ensuing detailed description taken in conjunction with the accompanying drawings.

BRIEF DESCRIPTION OF THE DRAWINGS

FIGS. 6, 6*a* and 6*b* shows a KTWLAF map;

DETAILED DESCRIPTION

The invention will be described in detail with reference to the drawings showing an embodiment thereof.

Figure 1:
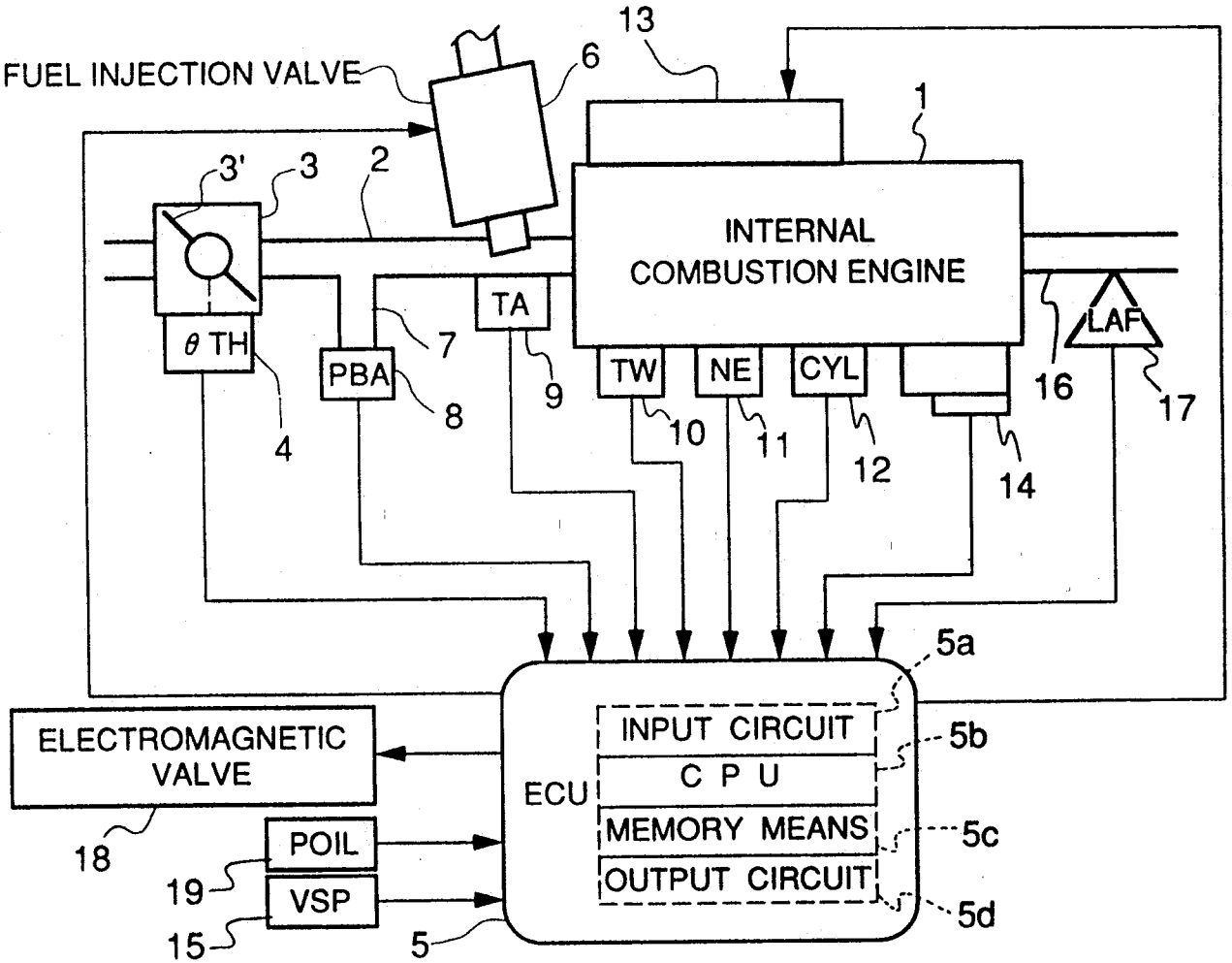
FIG. 1 is a block diagram showing an air-fuel ratio control system for an internal combustion engine, according to an embodiment of the invention.

Referring first to FIG. 1, there is shown the whole arrangement of an air-fuel ratio control system for an internal combustion engine, according to an embodiment of the invention.

In the figure, reference numeral 1 designates a DOHC straight type four cylinder engine, each cylinder being provided with a pair of intake valves and a pair of exhaust valves, not shown. This engine 1 is arranged such that the valve timing of the intake valves and exhaust valves can be selected between a high speed valve timing (high-speed V/T) adapted to a high engine speed region and a low speed valve timing (low-speed V/T) adapted to a low engine speed region.

In an intake pipe 2 of the engine 1, there is arranged a throttle body 3 accommodating a throttle body 3' therein. A throttle valve opening ($\theta$TH) sensor 4 is connected to the throttle valve 3' for generating an electric signal indicative of the sensed throttle valve opening and supplying same to an electronic control unit (hereinafter referred to as "the ECU") 5.

Fuel injection valves 6 are each provided for each cylinder and arranged in the intake pipe 2 between the engine 1 and the throttle valve 3, and at a location slightly upstream of an intake valve, not shown. The fuel injection valves 6 are connected to a fuel pump, not shown, and electrically connected to the ECU 5 to have their valve opening periods controlled by signals therefrom.

On the other hand, an intake pipe absolute pressure (PBA) sensor 8 is mounted at an end of a branch conduit 7 branching off from the intake pipe 2 at a location immediately downstream of the throttle valve 3', for sensing absolute pressure (PBA) within the intake pipe 2, and is electrically connected to the ECU 5 for converting the sensed absolute pressure PBA into an electric signal indicative thereof and supplying same to the ECU 5.

An intake air temperature (TA) sensor 9 is inserted into the intake pipe 2 at a location downstream of the intake pipe absolute pressure sensor 8 for supplying an electric signal indicative of the sensed intake air temperature TA to the ECU 5.

An engine coolant temperature (TW) sensor 10, which may be formed of a thermistor or the like, is mounted in the coolant-filled cylinder block of the engine 1 for supplying an electric signal indicative of the sensed engine coolant temperature TW to the ECU 5.

An engine rotational speed (NE) sensor 11 and a cylinder-discriminating (CYL) sensor 12 are arranged in facing relation to a camshaft or a crankshaft of the engine 31, neither of which is shown. The NE sensor 11 generates a pulse as a TDC signal pulse at each of predetermined crank angles whenever the crankshaft rotates through 180 degrees, while the CYL sensor 12 generates a pulse at a predetermined crank angle of a particular cylinder of the engine, both of the pulses being supplied to the ECU 5.

A spark plug 13 for each cylinder of the engine 1 is electrically connected to the ECU 5 to have ignition timing thereof controlled by a signal supplied therefrom.

A transmission 14 is interposed between the engine 1 and driving wheels, not shown, to allow the driving wheels to be driven by the engine 1.

A vehicle speed sensor (VSP) sensor 15 is provided at trailing wheels, not shown, for detecting the travelling speed VSP of the vehicle to supply an electric signal indicative of the sensed vehicle speed to the ECU 5.

A linear air-fuel ratio sensor (hereinafter referred to as "the LAF sensor") 17 is arranged across an exhaust pipe 16 of the engine 1 for detecting the concentration of oxygen present in exhaust gases emitted from the engine to supply an electric signal indicative of the sensed oxygen concentration to the ECU 5. The output from the LAF sensor 17 is approximately proportional to the oxygen concentration.

Connected to the output of the ECU 5 is an electromagnetic valve 18 which has the opening and closing operation thereof controlled by a signal from the ECU 5 for controlling changeover of the aforementioned valve timing of the intake and exhaust valves. The electromagnetic valve 18 effects changeover of hydraulic pressure prevailing within a valve timing changeover mechanism, not shown, between high and low levels, the valve timing changeover mechanism being actuated by selected level of hydraulic pressure to effect changeover of the valve timing between the high-speed V/T and the low-speed V/T. The hydraulic pressure within the changeover mechanism is detected by an oil pressure (POIL) sensor 19, from which an electric signal indicative of the sensed hydraulic pressure POIL is supplied to the ECU 5.

The ECU 5 comprises an input circuit **5*a* having the functions of shaping the waveforms of input signals from various sensors as mentioned above, shifting the voltage levels of sensor output signals to a predetermined level, converting analog signals from analog-output sensors to digital signals, and so forth, a central processing unit (hereinafter referred to as "the CPU") 5*b*, memory means 5*c* formed of a ROM storing various operational programs which are executed by the CPU 5*b*. and various maps, referred to hereinafter, and a RAM for storing results of calculations therefrom, etc.. an output circuit 5*d* which outputs driving signals to the fuel injection valves 6, the spark plugs 13 and the electromagnetic valve 18**, respectively.

The CPU **5*b* operates in response to the abovementioned signals from the sensors to determine operating conditions in which the engine 1 is operating, such as an air-fuel ratio feedback control region and open-loop control regions, and calculates, based upon the determined engine operating conditions, the valve opening period or fuel injection period TOUT over which the fuel injection valves 6 are to be opened by the use of the following formula (1) in synchronism with generation of TDC signal pulses and stores the results of calculation into the memory means (RAM) 35*c***:

$$TOUT = TiM \times KCMDM \times KLAF \quad (1)$$

where TiM represents a basic fuel injection amount determined according to the engine rotational speed NE and the intake pipe absolute pressure PBA. As TiM maps used in determining the value of TiM, there are stored in the memory means **35*c*** (ROM) a TiML map suitable for the low-speed V/T and a TiMH map suitable for the high-speed V/T.

KCMDM is a modified desired air-fuel ratio coefficient which is set by means of a program shown in FIG. 2, described hereinafter, according to engine operating conditions, and calculated by multiplying a desired air-fuel ratio coefficient KCMD representing an equivalent ratio of a desired air-fuel ratio by an air density-dependent correction coefficient KETC.

The desired air-fuel ratio coefficient KCMD is calculated by the use of the following equation (2):

$$KCMD = KBS \times KSP \times KLS \times KDEC \quad (2)$$

where KBS represents a basic value of the desired air-fuel ratio coefficient, which is normally read from a KBS map in which basic map values KBSM thereof are provided in a matrix associated with values of the engine rotational speed NE and those of the intake pipe absolute pressure PBA, a basic map value KBSM read from the KBS map being corrected, at standing start of the vehicle, at a low engine coolant temperature condition, or at a predetermined high-load condition, to make the basic value KBS suitable for these conditions. Further, the KBS map comprises a high-speed V/T (KBSH) map for use when the high-speed V/T is selected and a low-speed V/T (KBSL) map for use when the low-speed V/T is selected, both stored in the memory means **5*c*** (ROM).

KSP is a vehicle speed-dependent correction coefficient which is set depending on the vehicle speed VSP to such a predetermined value as to prevent occurrence of surging, etc. More specifically, when the engine is under a predetermined high-load condition, it is set to a value of "1.0", and otherwise to a predetermined value through retrieval of a KSP map, described hereinafter.

KLS represents a leaning correction coefficient which is set to predetermined values depending on operating regions of the engine.

KDEC represents a decelerating correction coefficient which is set to a predetermined value depending on a decelerating condition of the engine. More specifically, it is set to a value smaller than "1.0" when the vehicle is decelerating, and otherwise to a value of "1.0".

The correction coefficient KETC is intended to apply a prior correction to the fuel injection amount so as to compensate for variation of the supply air-fuel ratio due to the cooling effect produced when fuel is actually injected, and its value is set according to the value of the desired air-fuel ratio coefficient KCMD. Further, as is apparent from the aforementioned equation (1), the fuel injection period TOUT increases as the modified desired air-fuel ratio coefficient KCMDM increases, so that the modified value KCMDM of the equivalent ratio of the desired air-fuel ratio will assume a value which is in direct proportion to the reciprocal of the desired air-fuel ratio A/F.

KLAF represents an air-fuel ratio correction coefficient, which is set, during feedback control, such that the equivalent ratio of the supply air-fuel ratio detected based on the output voltage from the LAF sensor 17 (hereinafter referred to as "the detected air-fuel ratio coefficient") KACT becomes equal to the desired air-fuel ratio coefficient KCMD, whereas during open loop control it is set to predetermined values suitable for predetermined operating conditions of the engine.

Next, there will be described in detail a manner of calculating the desired air-fuel ratio coefficient KCMD and the modified desired air-fuel ratio coefficient KCMDM.

Figures 2, 2A, 2B:
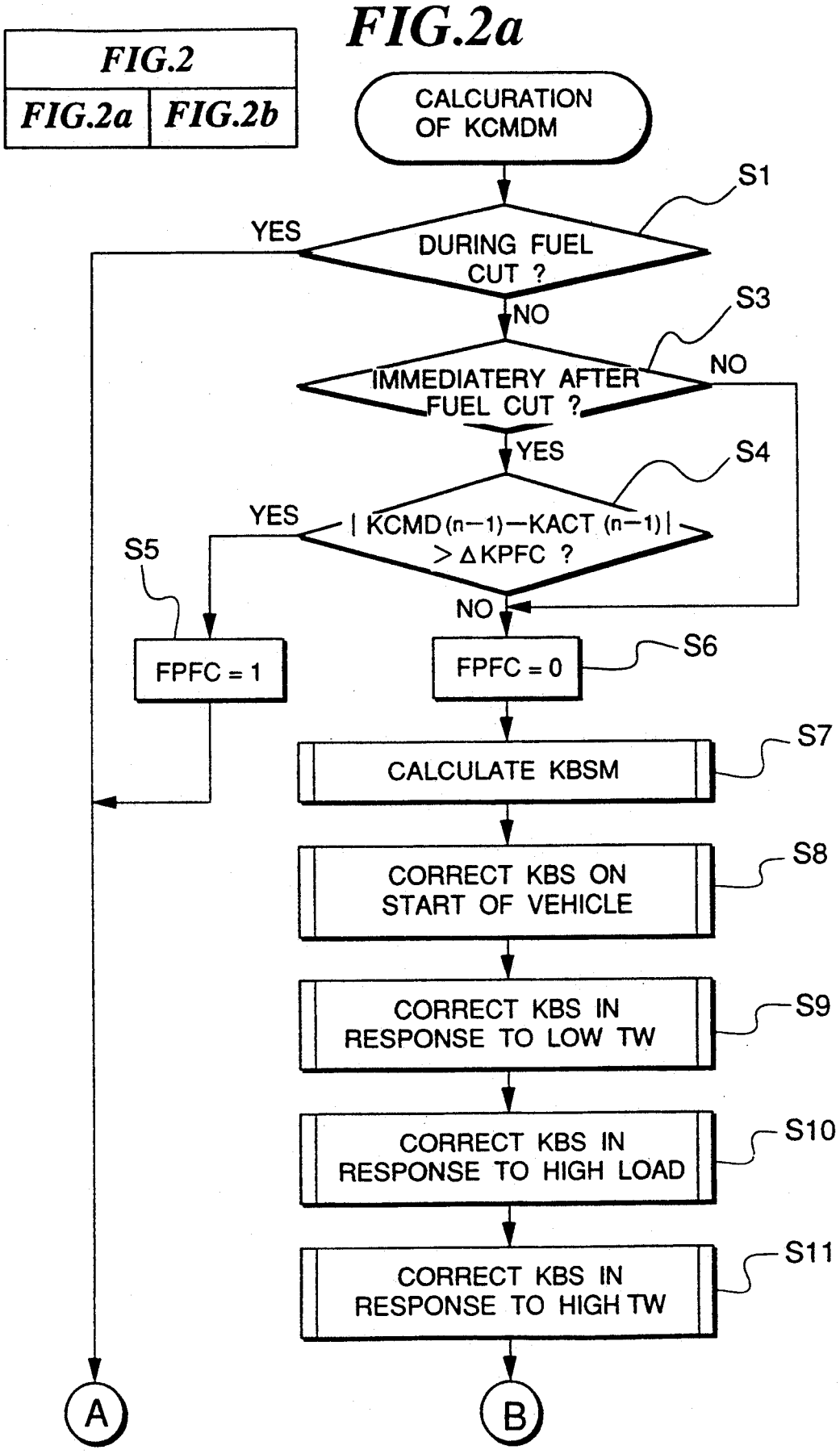
FIGS. 2, 2*a* and 2*b* is a flowchart of a routine for calculating a modified desired air-fuel ratio coefficient KCMDM.
Figure 2B:
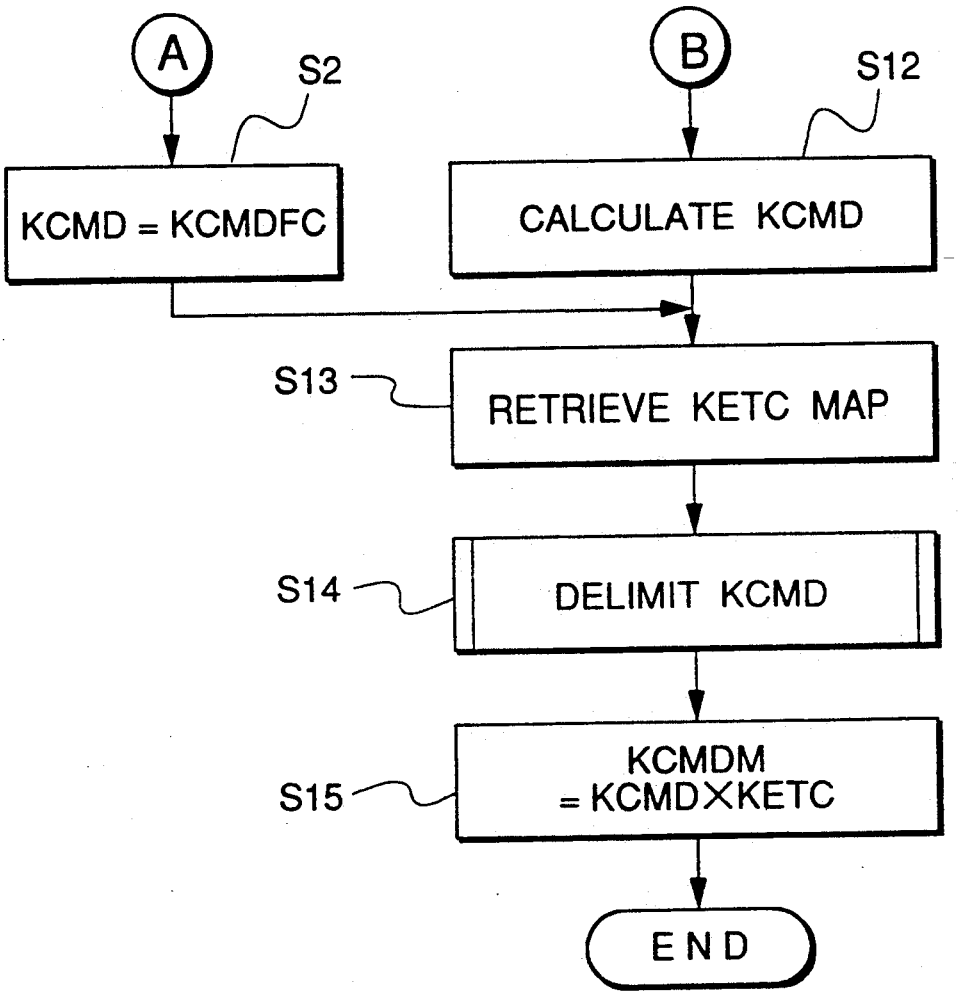

FIG. 2 shows a main routine for calculating the modified desired air-fuel ratio coefficient KCMDM, which is executed whenever a TDC signal pulse is generated.

First at a step S1, it is determined whether or not the engine 1 is under fuel cut. This determination is carried out based on the engine rotational speed NE and the throttle valve opening $\theta$TH, specifically by execution of a fuel-cut condition determining routine, not shown.

If the answer to this question is affirmative (YES), the desired air-fuel ratio coefficient KCMD is set to a predetermined value KCMDFC (e.g. 1.0) at a step S2, followed by the program proceeding to a step S13.

If the answer to the question of the step S1 is negative (NO), it is determined at a step S3 whether or not the present loop is immediately after fuel cut. This determination is carried out by starting a timer upon termination of fuel cut and determining whether or not the timer has counted up its set count value corresponding to a predetermined time period, e.g. 500 millisec. If the answer to this question is affirmative (YES), i.e. if the present loop is immediately after fuel out, the program proceeds to a step S4, where it is determined whether or not the absolute value of the difference between the immediately preceding value $KCMD_{(n-1)}$ of the desired air-fuel ratio coefficient KCMD and the immediately preceding value $KACT_{(n-1)}$ of the detected air-fuel ratio coefficient KACT is larger than a predetermined value ΔKPFC (e.g. 0.14).

In this connection, the detected air-fuel ratio coefficient KACT assumes a value corrected based on the intake pipe absolute pressure PBA, the engine rotational speed NE, and the atmospheric pressure PA, in view of the fact that the pressure of exhaust gases varies with variations in these engine operating parameters.

If the answer to the question of the step S4 is affirmative (YES), i.e. if the aforementioned difference is larger than the predetermined value ΔKPFC, a flag FPFC for indicating whether or not the present loop is immediately after fuel cut is set to "1" at a step S5, followed by the program proceeding to the step S2.

If the answer to the question of the step S3 or S4 is negative (NO), the flag FPFC is set to "0", and thereafter, the desired air-fuel ratio coefficient KCMD is calculated through execution of subroutines corresponding to steps S7 to S11 depending on various operating conditions of the engine, described hereinafter.

At the step S7, the basic map value KBSM is calculated by retrieving the KBS map according to the engine rotational speed NE and the intake pipe absolute pressure PBA.

Figure 3:
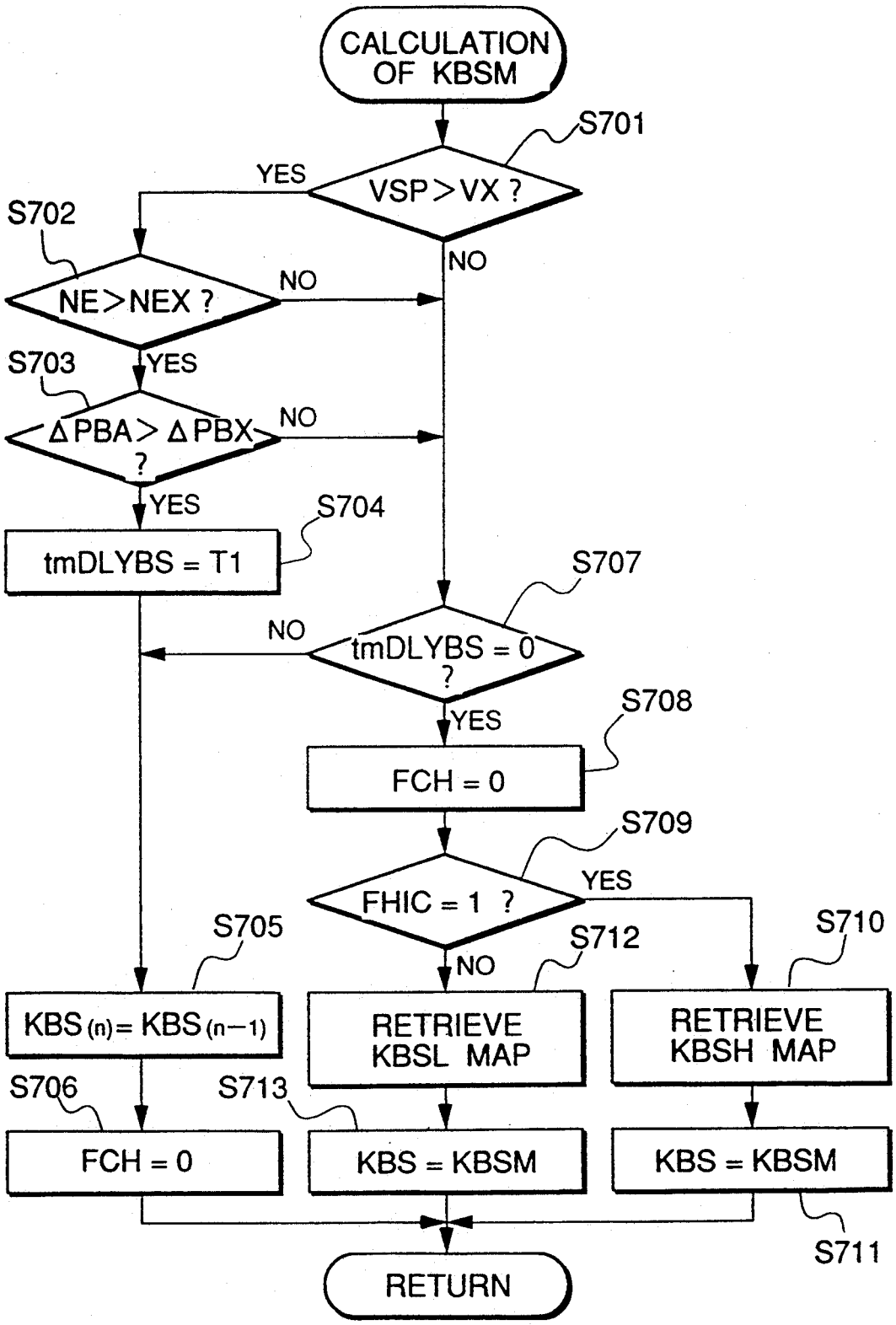
FIG. 3 is a flowchart of a routine for calculating a basic map value KBSM.

More specifically, as shown in FIG. 3, it is determined ar a step S701 whether or not the vehicle speed VSP detected by the VSP sensor 15 is higher than a predetermined value VX (e.g. 10 km/h). If the answer to this question is affirmative (YES), it is determined at a step S702 whether or not the engine rotational speed NE detected by the NE sensor 11 is higher than a predetermined value NEX (e.g. 900 rpm). If the answer to this question is affirmative (YES), it is determined at a step S703 whether or not the difference ΔPBA between the immediately preceding value $PBA_{(n-1)}$ and the present value $PBA_{(n)}$ of the intake pipe absolute pressure PBA obtained by subtracting the latter from the former is larger than a predetermined value ΔPBX (e.g. 20 mmHg), i.e. whether or not the load on the engine has drastically shifted to a lower side. If all the answers to the questions of the steps S701 to S703 are affirmative (YES), it is judged that the transmission 14 is being gear shifted, and then a first delay timer tmDLYBS is set to a predetermined value corresponding to a predetermined time period T1 (e.g. 300 millisec.) at a step S704, and the basic value KBS of the desired air-fuel ratio coefficient KBSM is held at the value obtained in the immediately preceding loop at a step S705. Then, a flag FCH is set to "1" at a step S706 to indicate that the transmission is being gear shifted, followed by returning to the main routine of FIG. 2.

On the other hand, if at least one of the answers to the questions of the steps S701 to S703 is negative (NO), the program proceeds to a step S707, where it is determined whether or not the count value of the first delay timer tmDLYBS indicates that the predetermined time period T1 has elapsed. If the answer to this question is negative (NO), the program proceeds to the aforementioned step S705, whereas if the answer is affirmative (YES), the program proceeds to a step S70B, where the flag FCH is set to "0" to indicate completion of the gear shifting of the transmission 14. Then, it is determined at a step S709 whether or not a flag FHIC has been set to "1" to indicate that the high-speed V/T has been selected. If the answer to this question is affirmative, i.e. if the high-speed V/T is in use, the program proceeds to a step S710, where the KBSH map is retrieved to read a KBSM value therefrom, and then the KBSM value thus obtained is stored into the memory means 5c (RAM) at a step S711 followed by returning to the main routine of FIG. 2. On the other hand, if the answer to the question of the step S709 is negative (NO). i.e. if the low-speed V/T is in use, the program proceeds to a step S712, where the KBSL map is retrieved to read a KBSM value therefrom, and then the KBSM value read from the KBSL map is stored into the memory means 5c (RAM) at a step S713, followed by returning to the main routine of FIG. 2.

Then at the step S8 of FIG. 2, it is determined whether or not the vehicle has just started from its standing position. If it is judged that the vehicle has just started from its standing position, the basic value KBS of the desired air-fuel ratio coefficient is corrected to a value suitable for the standing start condition of the vehicle.

Figure 4:
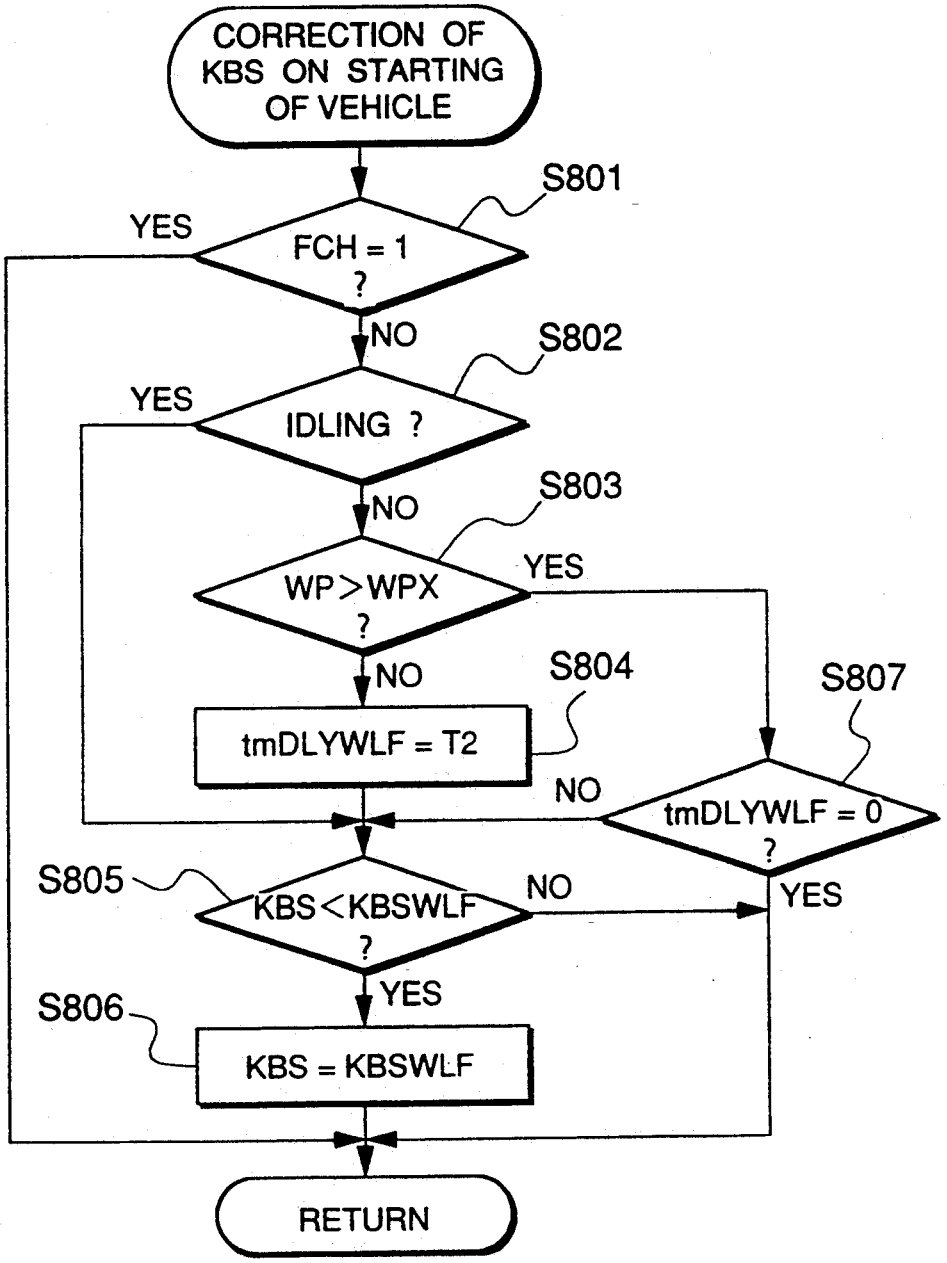
FIG. 4 is a flowchart of a routine for correcting a basic value KBS of a desired air-fuel ratio coefficient KCMD during starting of the vehicle.

More specifically, as shown in a subroutine of FIG. 4, first, it is determined at a step S801 whether or not the flag FCH has been set to "1". If the answer to this question is affirmative (YES), i.e. if the transmission is being gear shifted, the program returns to the main routine of FIG. 2 without correcting the basic value KBS of the desired air-fuel ratio to a value suitable for the standing start condition of the vehicle.

If the answer to the question of the step S801 is negative (NO), the program proceeds to a step S802, where it is determined whether or not the engine is idling. It is determined that the engine is idling, when the engine rotational speed NE is low (e.g. lower than 900 rpm) and at the same time the throttle valve opening θTH (detected by the θTH sensor 4) assumes a value to be assumed when the engine is idling, which value is equal to or smaller than a predetermined value θidl, or when the engine rotational speed NE is low as mentioned above, and at the same time the intake pipe absolute pressure PBA (detected by the PBA sensor 8) is lower than a predetermined value, i.e. on a lower load side than the predetermined value.

If the answer to the question of the step S802 is affirmative (YES), the program proceeds to a step S805, whereas if it is negative (NO), the program proceeds to a step S803, where it is determined whether or not a wheel speed WP indicative of a minute value of the vehicle speed VSP is higher than a predetermined value WPX to thereby determine whether or not the vehicle can be regarded as standing.

If the answer to the question of the step S803 is negative (NO), it is judged that the vehicle is standing, and a second delay timer tmDLYWLF is set to a predetermine count value corresponding to a predetermined time period T2 (e.g. 100 millisec.) and started, at a step S804, followed by returning to the step S805.

At the step S805, it is determined whether or not the basic value KBS, which has been set to a value read from the KBSM map at the step S711 or S713 in the subroutine of FIG. 3, or has been held to the immediately preceding value $KBS_{(n-1)}$ obtained in the immediately preceding loop at the step S705 in FIG. 3, is smaller than a predetermined value KBSWLF (e.g. 1.1). If the answer to this question is negative (NO), the program returns to the main routine of FIG. 2 without correcting the basic value KBS to a value suitable for the standing start condition of the vehicle, whereas if it is affirmative (YES), the KBS value is set to the predetermined value KBSWLF, followed by returning to the main routine of FIG. 2.

If the answer to the question of the step S803 is affirmative (YES), i.e. if it is judged that the vehicle is not standing, the program proceeds to a step S807, where it is determined whether or not the count value of the second delay timer tmDLYWLF is equal to "0", indicating that the predetermined time period T2 has elapsed. If the answer to this question is negative (NO), it is judged that the vehicle has just started from its standing position, so that the program proceeds to the step S805, followed by returning via the step S806 to the main routine of FIG. 2. On the other hand, if the answer to the question of the step S807 is affirmative (YES), it is judged that the vehicle is not at the standing start. so that the program returns to the main routine of FIG. 2 without correcting the basic value KBS to the value suitable for the standing start condition of the vehicle, i.e. the predetermined value KBSWLF. Thus, the basic value KBS of the desired air-fuel ratio coefficient KCMD is set to a value equal to or larger (i.e. richer) than the predetermined value KBSWLF at the standing start of the vehicle.

Then, at the step S9 of FIG. 2, the basic value KBS is corrected depending on the engine coolant temperature TW in order to prevent the supply air-fuel ratio from becoming leaner when the temperature TW is low.

Figure 5:
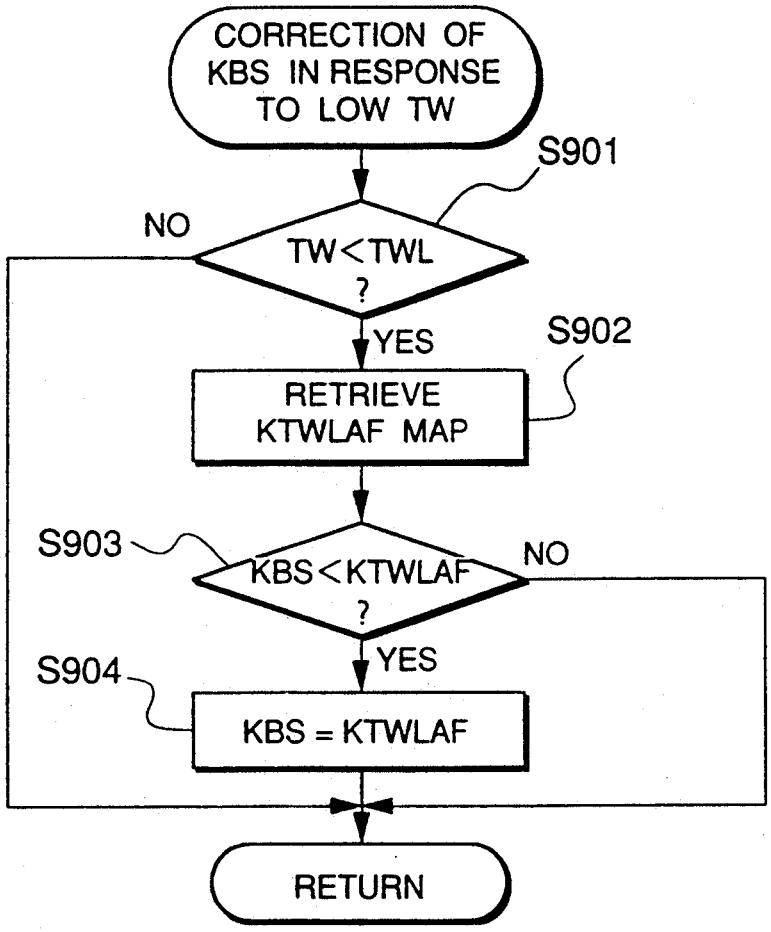
FIG. 5 is a flowchart of a routine for correcting the basic value KBS of the desired air-fuel ratio coefficient KCMD when the engine coolant temperature TW is low.

More specifically, as shown in a subroutine of FIG. 5, first at a step S901, it is determined whether or not the engine coolant temperature TW is lower than a predetermined value TWL. The predetermined value TWL is set to a value, e.g. 70° C., at which the supply air-fuel ratio will start to become leaner due to the low engine coolant temperature, i.e. the low temperature of the engine. If the answer to this question is affirmative (YES), i.e. if TW<TWL, a KTWLAF map is retrieved according to the engine coolant temperature TW and the intake pipe absolute pressure PBA to read a predetermined value KTWLAF of the basic value KBS suitable for the low engine coolant temperature condition at a step S902.

Figures 6A, 6B:
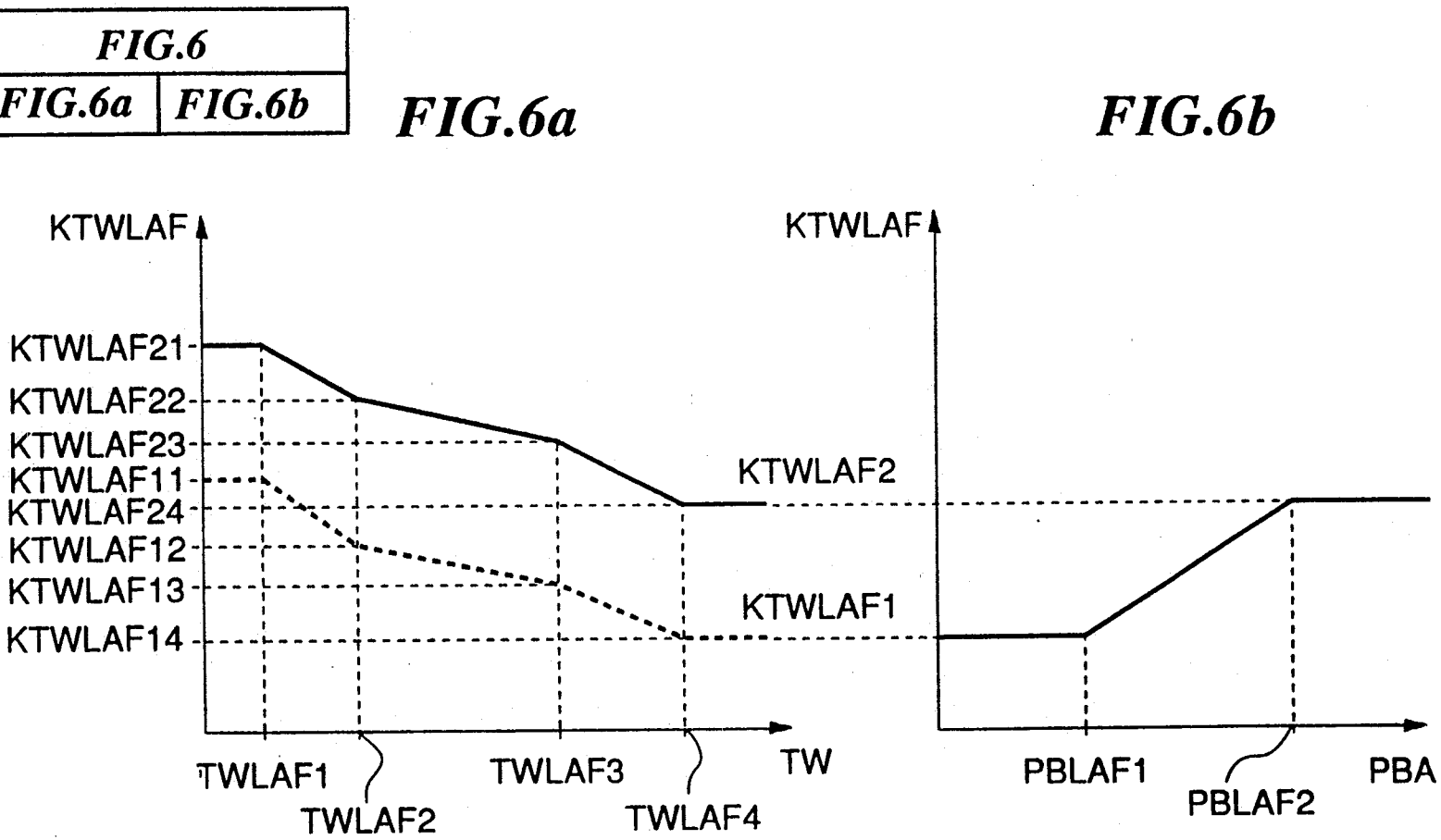

As shown in FIG. 6, the KTWLAF map comprises a characteristic curve KTWLAF1 (indicated by the broken line in (a) of FIG. 6) to be applied when the intake pipe absolute pressure PBA is below a predetermined value PBLAF1, and a characteristic curve KTWLAF2 (indicated by the solid line in (a) of same) to be applied when the intake pipe absolute pressure PBA is above a predetermined value PBLAF2. As shown in (a) of the figure, predetermined values KTWLAF11 to KTWLAF14 and KTWLAF21 to KTWLAF24 are set corresponding respectively to predetermined values TWLAF1 to TWLAF4 of the engine coolant temperature TW. Accordingly, at the step S902, if a condition of PBA≧PBLAF2 or PBA≦PBALAF1 is satisfied, a value on the characteristic curve KTWLAF2 or KTWLAF1 is read from the KTWLAF map at (a) of the figure according to the engine coolant temperature (KTWLAF values corresponding to values other than the predetermined set values TWLAF1 to TWLAF4 are obtained by interpolation according to the engine coolant temperature TW), whereas if a condition of PBLAF1<PBA<PBLAF2 is satisfied, values on the characteristic curves KTWLAF2 and KTLAF1 are read in a similar manner from (a) of the figure and the read values are subjected to interpolation according to the intake pipe absolute pressure PBA to calculate a value of KTWLAF. The values of KTWLAF set in the KTWLAF map are richer than a value corresponding to a stoichiometric air-fuel ratio, and by thus setting the basic value KBSM of the desired air-fuel ratio to a value of KTWLAF richer than the stoichiometric ratio, the amount of fuel supplied to the engine is increased when the engine coolant temperature is low.

Then, at a step S903, it is determined whether or not the KBS value is smaller than the KTWLAF value obtained at the step S902. If the answer to this question is negative (NO), the program returns to the main routine of FIG. 2 without correcting the basic value KBS of the desired air-fuel ratio coefficient KCMD, whereas if the answer is affirmative (YES), the program proceeds to a step S904, where the basic value KBS is set to the KTWLAF value obtained at the step S902, followed by returning to the main routine of FIG. 2. Thus, the basic value KBS is set to a value equal to or larger than the KTWLAF value.

In addition, if the answer to the question of the step S901 is negative (NO), the program immediately returns to the main routine without correcting the KBS value to a value suitable for the low engine coolant temperature condition, since the engine coolant temperature TW is not low.

Thus, by execution of the steps S7 to S9 of FIG. 2, the basic value KBS has been set to the largest one of the immediately preceding value thereof, the KBSM value, the predetermined value KBSWLF, and the KTWLAF value.

Then, at a step S10 in FIG. 2. it is determined whether or not the engine is in a predetermined high load condition, and if the engine is in the predetermined high load condition, the basic value KBS is corrected to a value suitable for this condition of the engine.

Figure 7:
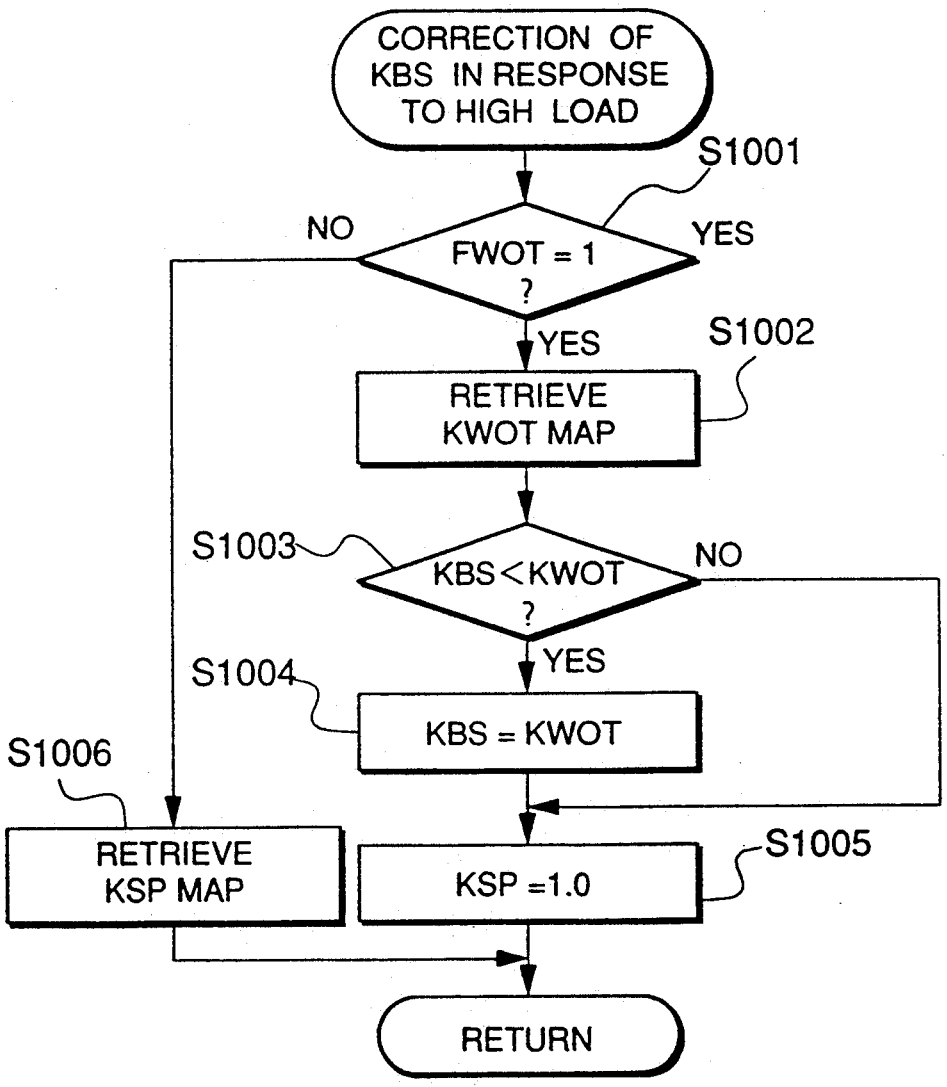
FIG. 7 is a flowchart of a routine for correcting the basic value KBS of the desired air-fuel ratio coefficient KCMD when the engine is in a high-load condition.

More specifically, as shown in a subroutine of FIG. 7, at a step S1001, it is determined whether or not the flag FWOT has been set to "1" to thereby determine whether or not the engine is in a predetermined high load condition (e.g. the throttle valve 3' is substantially fully opened). If the answer to this question is affirmative (YES), it is judged that the engine is in the predetermined high load condition, the program proceeds to a step S1002, where a KWOT map is retrieved to read a high-load condition map value KWOT therefrom. The KWOT map has predetermined values KWOT corresponding respectively to predetermined values of the engine rotational speed NE and those of the intake pipe absolute pressure PBA. and a KWOT value is read by retrieving the KWOT map or by interpolation, if required. In this connection, as the KWOT map, there are provided a high-speed V/T (KWOTH) map to be used when the high-speed V/T is in use, and a low-speed V/T (KWOTL) map to be used when the low-speed V/T is in use, both stored in the memory means 5c (ROM).

Then, at a step S1003, it is determined whether or not the high-load condition map value KWOT thus obtained is larger than the basic value KBS. If the answer to this question is negative (NO), i.e. if KWOT≦KBS, the basic value KBS is not changed but the vehicle speed-dependent correction coefficient KSP is set to "1.0" at a step S1005, followed by returning to the main routine of FIG. 2. If the answer to this question is affirmative (YES), i.e. if KWOT>KBS, the basic value KBS is set to the KWOT value at a step S1005, and then the vehicle speed-dependent correction coefficient KSP is set to "1.0" at a step S1006, followed by returning to the main routine of FIG. 2, whereby the basic value KBS is set to a value equal to or larger than the KWOT value when the engine is in the predetermined high load condition. Thus, by execution of the steps S7 to S10 of FIG. 2, the basic value KBS is set to the largest one (i.e. the richest one) of the immediately preceding value thereof, the basic map value KBSM, the predetermined value KBSWLF, the KTWLAF value, and the KWOT value.

Figure 8:
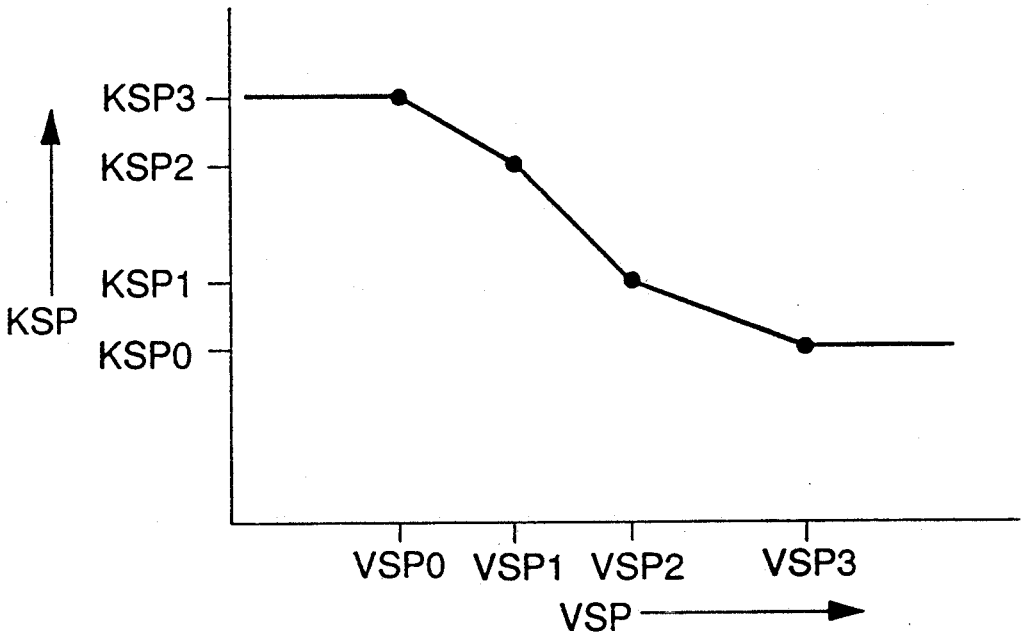
FIG. 8 shows a KPS map.

On the other hand, if the answer to the question of the step S1001 is negative (NO), i.e. if the engine is not in the high load condition, a KSP map is retrieved to read a vehicle speed-dependent correction coefficient KSP therefrom at a step S1007, followed by returning to the main routine of FIG. 2. The KSP map is set, for example, as shown in FIG. 8, which has predetermined KSP values corresponding respectively to predetermined values VSP0 to VSP3 of the vehicle speed VSP. A KSP value is obtained by retrieval of the KSP map or by interpolation, if required. In this connection, as is clear from the map shown in FIG. 8, the vehicle speed-dependent correction coefficient KSP is set to a larger value as the vehicle speed VSP is lower.

Then, at a step S11 in FIG. 2, it is determined whether or not the engine coolant temperature is high, and if it is high, the basic value KBS is corrected to a value suitable for the high engine coolant temperature condition of the engine.

Figure 9:
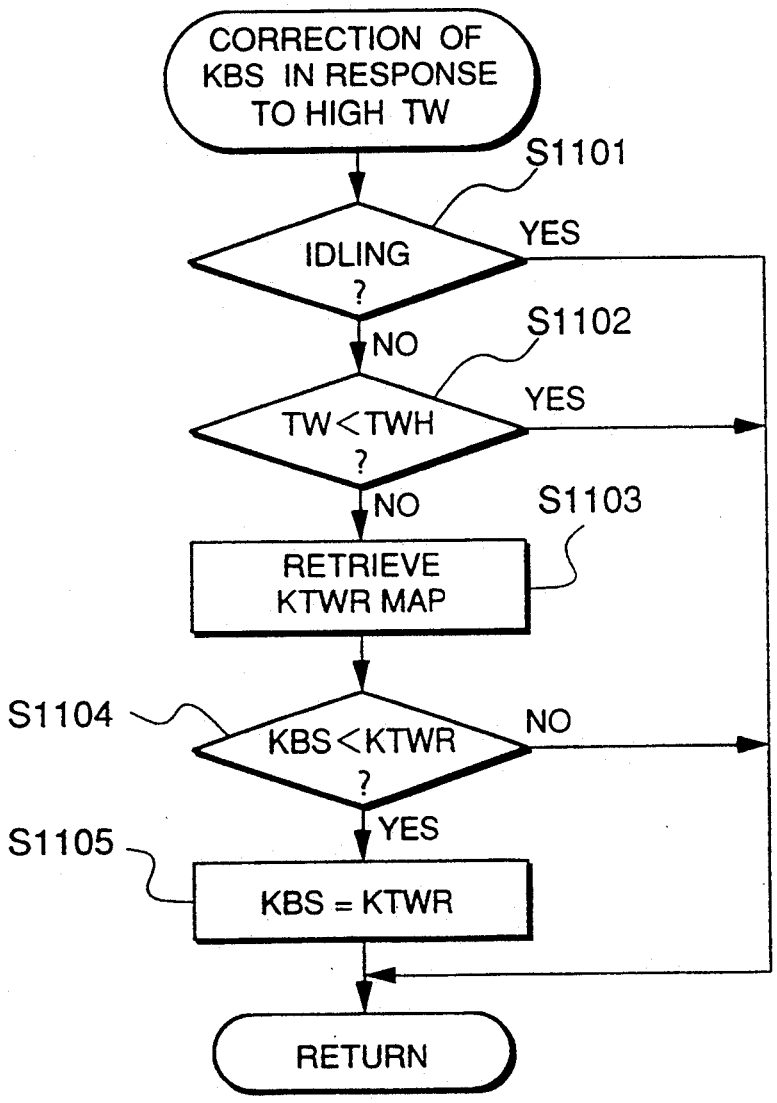
FIG. 9 is a flowchart of a routine for correcting the basic value KBS of the desired air-fuel ratio coefficient KCMD when the engine coolant temperature TW is high.
Figure 10:
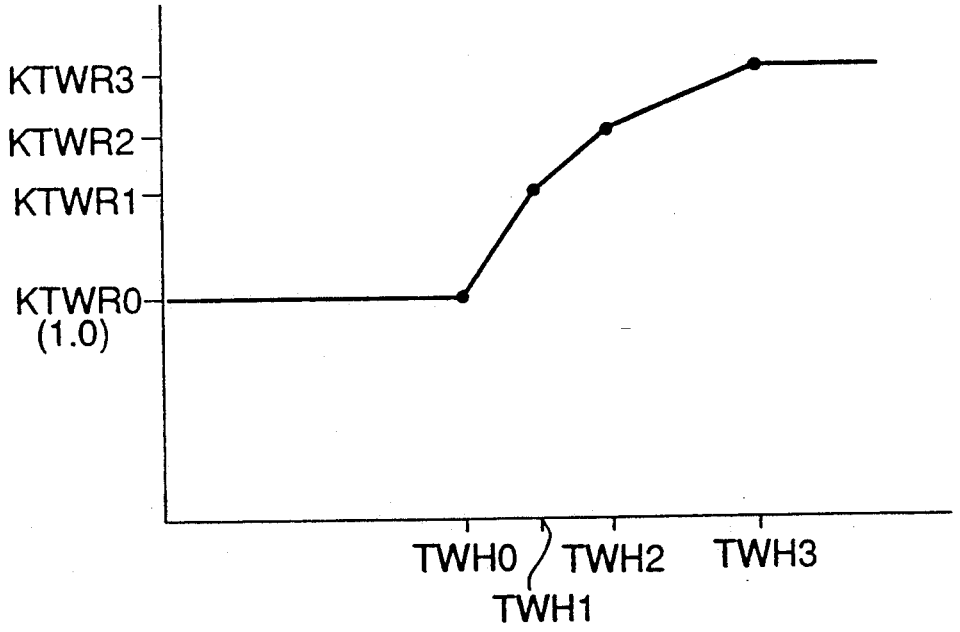
FIG. 10 shows a KTWR map.

More specifically, as shown in a subroutine of FIG. 9. at a step S1101, it is determined whether or not the engine is idling, in the same manner as described hereinbefore with reference to the step S802 in FIG. 4. If the answer to this question is affirmative (YES), the program returns to the main routine of FIG. 2, whereas if it is negative (NO), the program proceeds to a step S1102, where it is determined whether or not the engine coolant temperature TW is lower than a predetermined value TWH. The predetermined value TWH is set to a value, e.g. 107° C., at which the supply air-fuel ratio will start to become enriched. If the answer to this question is affirmative (YES), the program returns to the main routine without correcting the basic value KBS since the engine coolant temperature TW is not so high. On the other hand, if the answer to the question of the step is negative (NO), the program proceeds to a step S1103, where a KTWR map is retrieved to read a predetermined value KTWR of the basic value KBS suitable of the desired air-fuel ratio coefficient KCMD for the high engine coolant temperature condition of the engine. The KTWR is set, for example, as shown in FIG. 10, which has predetermined KTWR values KTWRO to KTWR3, the value of KTWRO being set to "1.0", corresponding respectively to predetermined values TWH0 to TWH3 of the engine coolant temperature. A TKWR value is obtained by retrieval of the the KTWR map, and by interpolation, if required. In this connection, as is apparent from FIG. 10, the value KTWR is set to a larger value as the engine coolant temperature is higher.

Then, at a step S1104, it is determined whether or not the KBS value obtained by execution of the steps S7 to S10, described hereinbefore, is smaller than the KTWR value. If the answer to this question is negative (NO), i.e. if KBS≧KTWR, the program returns to the main routine without correcting the basic value KBS, since the KBS value set heretofore is richer than the KTWR. On the other hand, if the answer to the question of the step S1104 is affirmative (YES), the basic value KBS is set to the KTWR value to obtain a corrected value suitable for the high engine temperature condition, followed by returning to the main routine of FIG. 2.

Then, at a step S12 of FIG. 2, the KBS value and the KSP value thus obtained are multiplied by the leaning correction coefficient KLS and the decelerating correction coefficient KDEC to calculate the desired air-fuel ratio coefficient KCMD (see the equation (2)).

Figure 11:
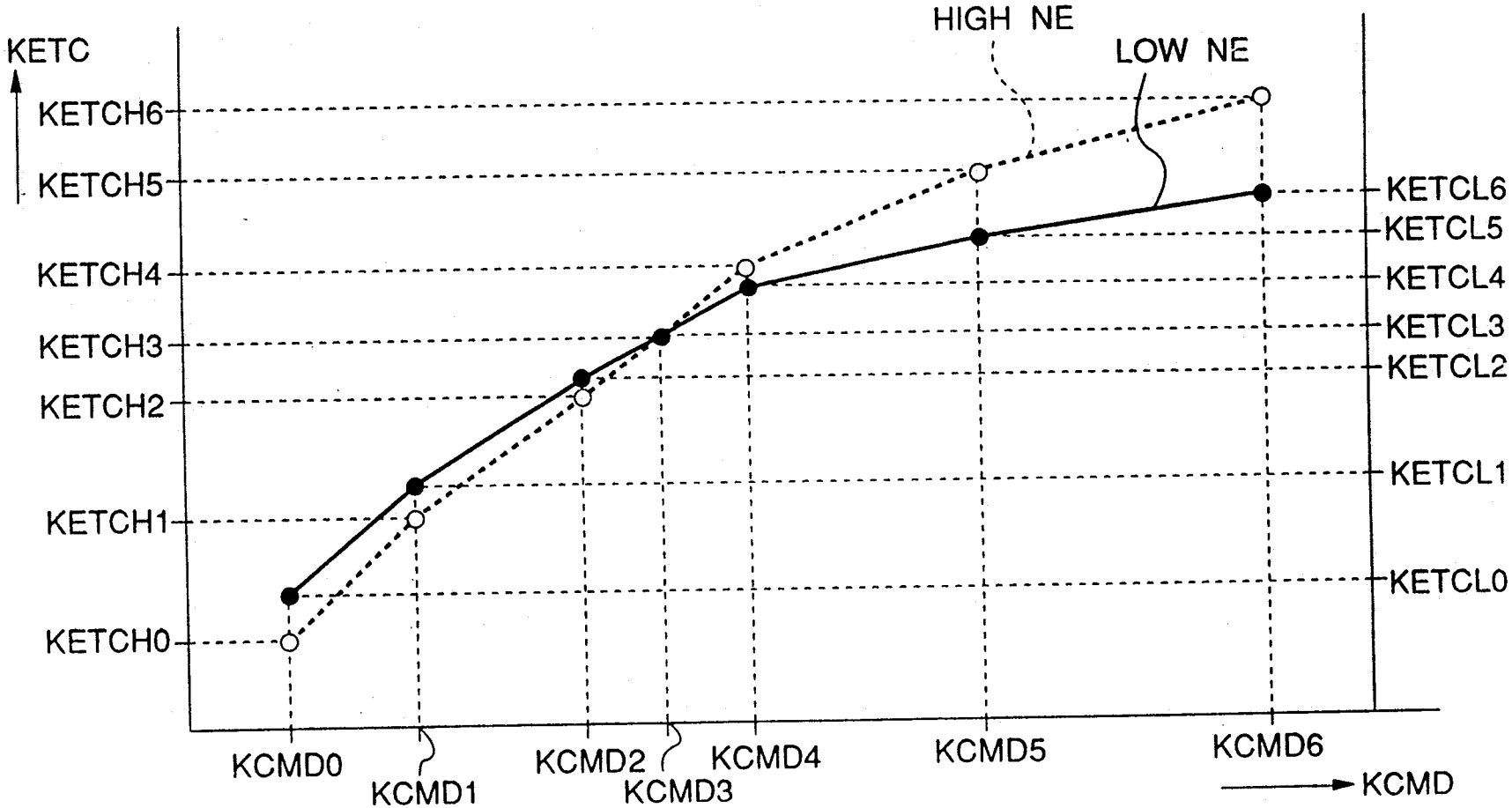
FIG. 11 shows a KETC map.

Then, at a step S13, a KETC map is retrieved to read a value of the air density-dependent correction coefficient KETC therefrom. The KETC map is set, for example, as shown in FIG. 11, which has predetermined KETCH values KETCH0 to KETCH6 to be selected when the engine rotational speed NE is higher than a predetermined high value (e.g. 3000 rpm), and predetermined KETCL values KETCL0 to KETCL6 to be selected when the engine rotational speed NE is lower than a predetermined low value (e.g. 2500 rpm), both the groups of predetermined KETC values corresponding respectively to predetermined values of the desired air-fuel ratio coefficient KCMD, and if the desired air-fuel ratio coefficient KCMD assumes a value other the predetermined values, a KETC value is obtained by interpolation. In the figure, the solid line indicates a curve for the low engine rotational speed region, while the broken line a curve for the high engine rotational speed region, and the co-ordinates of the intersection (KCMD3, KETC3) assume a value of 14.7 of KCMD and a value of 1.0 of KETC. In addition, although in the present embodiment, the KETC map is formed of different maps selected depending on the engine rotational speed, it may be formed of different maps which can be selected depending on the load on the engine.

The above described calculation of a suitable KETC value corresponding to the desired air-fuel ratio coefficient KCMD enables to modify the desired air-fuel ratio coefficient KCMD in a manner properly compensating for a change in the intake air density caused by the cooling effect of fuel actually injected.

Then, at a step S14 of FIG. 2, limit check of the KCMD value is carried out so as to avoid too drastic a change in the coefficient KCMD by preventing the difference between the present value and the immediately preceding value of the coefficient KCMD from exceeding an upper limit value set according to operating conditions of the engine.

Finally at a step S15, the coefficient KCMD is multiplied by the KETC value to calculate the modified desired air-fuel ratio coefficient KCMDM, followed by terminating the present routine. Then, the fuel injection period TOUT is calculated by the use of the equation (1).

Thus, according to the air-fuel ratio control system of the invention, the desired air-fuel ratio coefficient KCMD (and hence the modified desired air-fuel ratio KCMDM) which has been corrected in response to the standing start condition of vehicle, the low engine coolant temperature, and the high load on the engine, can be obtained by execution of a single loop of the main routine, which simplifies the process of calculation of the fuel injection time period TOUT.

Further, the desired air-fuel ratio coefficient KCMD can be calculated without multiplying the basic fuel injection period TiM by numerous correction coefficients as described in the Prior Art of this specification (see the equation (1')), which enables to obtain an optimal value of the fuel injection period TOUT in a quick manner.

What is claimed is:

1. In an air-fuel ratio control system for an internal combustion engine installed on an automotive vehicle, said engine having an exhaust passage, said system including an exhaust gas ingredient concentration sensor arranged across said exhaust passage for detecting the air-fuel ratio of an air-fuel mixture supplied to said engine, said system controlling the air-fuel ratio of said mixture to a desired air-fuel ratio set according to operating conditions of said engine, in response to an output from said exhaust gas ingredient concentration sensor, the improvement comprising:

rotational speed-detecting means for detecting the rotational speed of said engine;

load-detecting means for detecting load on said engine;

first air-fuel ratio-calculating means for calculating a first value of said desired air-fuel ratio based on the engine rotational speed detected by said rotational speed-detecting means and the load on the engine detected by the load-detecting means;

start-determining means for determining whether or not said vehicle has just started from a standing position thereof;

second air-fuel ratio-calculating means for calculating a second value of said desired air-fuel ratio based on results of determination by said start-determining means;

low temperature-determining means for determining whether or not a temperature of said engine is lower than a predetermined value;

third air-fuel ratio-calculating means for calculating a third value of said desired air-fuel ratio based on results of determination by said low temperature-determining means; and setting means for setting the largest value of at least said first to third values of said desired air-fuel ratio calculated by said first to third air-fuel ratio-calculating means to a final value of said desired air-fuel ratio.

2. An air-fuel ratio control system according to claim 1, further including high-load condition determining means for determining whether or not said engine is in a predetermined high-load condition, and fourth air-fuel ratio-calculating means for calculating a fourth value of said desired air-fuel ratio, and wherein said setting means sets the largest value of at least said first to fourth values of said desired air-fuel ratio calculated by said first to fourth desired air-fuel ratio-calculating means to said final value of said desired air-fuel ratio.

3. An air-fuel ratio control system according to claim 2, further including high temperature-determining means for determining whether or not the temperature of said engine is higher than a predetermined value, and fifth air-fuel ratio-calculating means for calculating a fifth value of said desired air-fuel ratio based on results of determination by said high temperature-determining means, and wherein said setting means sets the largest value of at least said first to fifth values of said desired air-fuel ratio calculated by said first to fifth desired air-fuel ratio-calculating means to said final value of said desired air-fuel ratio.

4. An air-fuel ratio control system according to any of claims 1 to 3, wherein the temperature of said engine is the temperature of coolant of said engine.

5. An air-fuel ratio control system according to any of claims 1 to 3, including fuel cut-determining means for determining whether or not the supply of fuel to said engine is being cut off, measuring means for measuring a time period elapsed after resumption of fuel supply to said engine when said fuel cut determining means has determined that the supply of fuel to said engine is not being cut off, and enabling means for permitting calculation of said desired air-fuel ratio when a predetermined time period has been measured by said measuring means.

6. An air-fuel ratio control system according to any of claims 1 to 3, wherein said vehicle includes a transmission connected to said engine, and said air-fuel ratio control system including gear shift-determining means for determining whether or not said transmission is being gear shifted, and inhibiting means for inhibiting said first air-fuel ratio-calculating means from calculating said first value of said desired air-fuel ratio when said gear shift-determining means has determined that said transmission is being gear shifted.

7. An air-fuel ratio control system according to claim 5, wherein said vehicle includes a transmission connected to said engine, and said air-fuel ratio control system including gear shift-determining means for determining whether or not said transmission is being gear shifted, and inhibiting means for inhibiting said first air-fuel ratio-calculating means from calculating said first value of said desired air-fuel ratio when said gear shift-determining means has determined that said transmission is being gear shifted.

8. An air-fuel ratio control system according to claim 6, wherein said gear shift-determining means includes load change-determining means for determining a change in load on said engine, said gear shift-determining means determining that said transmission is being shifted when the engine rotational speed detected by said rotational speed-detecting means exceeds a predetermined value, and said change in load on said engine exceeds a predetermined value.

9. An air-fuel ratio control system according to claim 6, wherein said gear shift-determining means includes vehicle speed-detecting means for detecting the travelling speed of said vehicle, said gear shift-determining means determining whether said transmission is being gear shifted when the travelling speed of said vehicle detected by vehicle speed-detecting means exceeds a predetermined value.

10. An air-fuel ratio control system according to claim 6, including second measuring means for measuring a time period elapsed after termination of gear shifting of said transmission, wherein said inhibiting means inhibits said first air-fuel ratio-calculating means from calculating said first value of said desired air-fuel ratio before said time period measured by said second measuring means reaches a predetermined value.

11. An air-fuel ratio control system according to any of claims 1 to 3, wherein said start-determining means includes idling-determining means for determining whether or not said engine is idling.

12. An air-fuel ratio control system according to claim 5, wherein said start-determining means includes idling-determining means for determining whether or not said engine is idling.

13. An air-fuel ratio control system according to claim 6, wherein said start-determining means includes idling-determining means for determining whether or not said engine is idling.

14. An air-fuel ratio control system according to claim 7, wherein said start-determining means includes idling-determining means for determining whether or not said engine is idling.

* * * * *